US009764549B2

(12) United States Patent
Kimoto

(10) Patent No.: US 9,764,549 B2
(45) Date of Patent: Sep. 19, 2017

(54) PRINTING APPARATUS

(71) Applicant: Seiko Epson Corporation, Tokyo (JP)

(72) Inventor: Yoshiyuki Kimoto, Ikeda-Machi (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/179,564

(22) Filed: Jun. 10, 2016

(65) Prior Publication Data

US 2016/0375706 A1 Dec. 29, 2016

(30) Foreign Application Priority Data

Jun. 29, 2015 (JP) ..... 2015-129590

(51) Int. Cl.

| | |
|---|---|
| ***B41J 2/045*** | (2006.01) |
| ***B41J 19/20*** | (2006.01) |
| ***B41J 2/125*** | (2006.01) |
| ***B41J 3/407*** | (2006.01) |
| ***B41J 11/00*** | (2006.01) |

(52) U.S. Cl.

CPC ..... *B41J 2/04586* (2013.01); *B41J 2/125* (2013.01); *B41J 3/4078* (2013.01); *B41J 11/0095* (2013.01); *B41J 19/207* (2013.01)

(58) Field of Classification Search

CPC ..... B41J 25/304; B41J 2/04508

See application file for complete search history.

(56) References Cited

U.S. PATENT DOCUMENTS

| | | | | |
|---|---|---|---|---|
| 7,731,330 | B2 * | 6/2010 | Nakata | B41J 19/20 347/19 |
| 8,177,320 | B2 | 5/2012 | Hagiwara | |
| 2010/0165022 | A1 * | 7/2010 | Makuta | B41J 2/04508 347/9 |

FOREIGN PATENT DOCUMENTS

| | | |
|---|---|---|
| JP | 2005-231155 | 9/2005 |
| JP | 2010-188532 | 9/2010 |
| JP | 5338476 B2 | 8/2013 |

* cited by examiner

*Primary Examiner* — Jason Uhlenhake

(74) *Attorney, Agent, or Firm* — Harness, Dickey & Pierce, P.L.C.

(57) ABSTRACT

A printing apparatus including a discharge head that performs scanning movement with respect to a print medium and discharges ink to a surface of the print medium, a signal output unit which includes a reference scale in which optical density changes stepwise along a scanning movement direction of the discharge head and a reading unit that optically reads the reference scale and outputs a signal according to the optical density and in which the reference scale and the reading unit move relatively with each other along with the movement of the discharge head, and a stain detection unit that detects stain of the signal output unit based on a detection result of a strength level of the signal.

9 Claims, 8 Drawing Sheets

FIG. 7A

| SERIAL NUMBER | PRINT MODE | PRINT EXECUTION TIME | DETAILS OF ABNORMALITY |
|---|---|---|---|
| 1 | | | |
| 2 | | | |
| 3 | | | |
| ⋮ | | | |
| | | | |
| | | | |

FIG. 7B

| PRINT MODE | PG [mm] | RESOLUTION [DPI] | EVALUATION (AMOUNT OF MIST GENERATION) |
|---|---|---|---|
| A | 1 | 1200 | SMALL |
| B | 5 | 1200 | LARGE |
| C | 1 | 600 | MEDIUM |
| ⋮ | | | |
| | | | |

PRINTING APPARATUS

BACKGROUND

1. Technical Field

The present invention relates to a printing apparatus that performs printing on a print medium by causing a discharge head to perform scanning movement and, in particular to, a technique that optically detects displacement of a discharge head.

2. Related Art

For example, in a printing apparatus such as an ink jet printer that performs printing on a print medium by discharging ink from a discharge head that performs scanning movement with respect to the print medium, an optical detection means may be used to detect displacement of the discharge head. For example, in a technique described in JP-A-2010-188532 (for example, FIG. 3), a displacement of a carriage is detected by a linear encoder in which a scale fixed to a printing apparatus and an optical sensor attached to a carriage are combined. In such a printing apparatus, there is a problem that a detection sensitivity of position or displacement gradually degrades due to adhesion of ink mist flying from a discharge head.

For this problem, the technique described in JP-A-2010-188532 estimates a timing at which the service life of an encoder expires by associating an occurrence frequency of false detection with an integrated amount of used ink and notifies a user of the service life and/or sends warning to a user as needed.

A use mode of the printing apparatus as described above varies depending on each user, so that the service life estimation described above may not function appropriately in some cases. For example, in order to reduce the possibility that the discharge head comes into contact with a print medium during printing and an error occurs, the printing may be performed in a state in which a gap between the discharge head and the print medium is larger than an appropriate value. In such a case, generation of mist is larger than that during printing using an appropriate gap, so that staining in the apparatus progresses faster than estimation obtained from the amount of used ink. In the related art described above, it is not possible to handle such a problem and it is difficult to appropriately perform the service life management of the detection means.

SUMMARY

An advantage of some aspects of the invention is to provide a technique that can appropriately perform service life management of a detection means that detects displacement of a discharge head in a printing apparatus that performs printing on a print medium by causing a discharge head to perform scanning movement.

A printing apparatus according to an aspect of the invention includes a discharge head that performs scanning movement with respect to a print medium and discharges ink to a surface of the print medium, a signal output unit which includes a reference scale in which optical density changes stepwise along a scanning movement direction of the discharge head and a reading unit that optically reads the reference scale and outputs a signal according to the optical density and in which the reference scale and the reading unit move relatively with each other along with the movement of the discharge head, and a stain detection unit that detects stain of the signal output unit based on a detection result of a strength level of the signal.

In the invention configured as described above, a stepwise variation occurs in a reading result of the reference scale along with the scanning movement of the discharge head, so that it is possible to detect the displacement of the discharge head by, for example, detecting a variation timing of the stepwise variation. On the other hand, the strength level of the signal varies along with the progress of the stain of the signal output unit, so that the strength level of the signal can be used as information indicating the stain of the signal output unit. In the invention, a detection result according to an actual progress status of the stain of the signal output unit is obtained by detecting the strength level of the signal, so that it is possible to more appropriately perform service life management of the signal output unit.

For example, the stain detection unit can be configured to detect the strength level of the signal by converting the signal into a multi-valued data of three values or more. Only the variation timing of the signal has to be detected to detect the displacement of the discharge head, so that it is sufficient to binarize the signal. On the other hand, in the invention, it is possible to more finely detect the change of the strength level by converting the signal into a multi-valued data of three values or more, and it is possible to evaluate the stain of the signal output unit from the detection result of the above.

Further, for example, the printing apparatus may be provided with a signal history holding unit that holds information related to a history of change in the strength level of the signal. Thereby, how the strength level of the signal changes with time is known, so that it is possible to utilize such history information for service life estimation of the signal output unit.

In this case, for example, a setting history holding unit that holds information related to a history of a print setting and an evaluation unit that evaluates a correlation between the print setting and the stain based on the information held by the signal history holding unit and the information held by the setting history holding unit may be further provided. The amount of generation of the mist of ink from the discharge head varies depending also on the print setting, so that it is possible to realize more accurate service life management by obtaining a correlation between the print setting and the progress of stain.

Further, for example, a notification unit that notifies a user of a print setting that is evaluated to be highly correlated with the stain by the evaluation unit may be provided. According to such a configuration, it is possible to cause a user to notice that a setting is selected which easily generates stain and shortens the service life of the signal output unit.

Further, for example, the notification unit may be configured to notify a user of a print setting whose correlation with the stain is lower than that of the current print setting. According to such a configuration, it is possible to guide a user in printing in a print setting where stain is more difficult to occur and prevent the stain from progressing.

Further, for example, an estimation unit that estimates a service life of the signal output unit in printing based on one print setting, based on an evaluation result of the evaluation unit may be provided. When a correlation between the stain and each print setting is known, it is possible to calculate a progress status of the stain to some extent when a print setting is continuously used and it is also possible to estimate the service life of the signal output unit when the same print setting is continuously used. When service life estimation is performed in this way, timing of cleaning and part replacement is known in advance, so that convenience of a user is improved.

Further, for example, the setting history holding unit may be configured to integrate an amount of performed operation of the discharge head under a print setting for each print setting. Even in the same print setting, the greater the amount of operation of the discharge head, the greater the amount of generation of the mist. Therefore, when the amount of operation of the discharge head is integrated, it is possible to more accurately know the progress status of the stain and the service life of the signal output unit. The amount of operation of the discharge head can be represented by, for example, the execution time of print processing and the number of times of the scanning movement of the discharge head.

Further, for example, the setting history holding unit may be configured to hold the number of times of occurrence of detection error of the displacement in the displacement detection unit for each print setting. As the stain of the signal output unit progresses, the displacement detection in the displacement detection unit cannot be appropriately performed. It is possible to identify a print setting where the detection error easily occurs, that is, the stain easily progresses, by storing the number of times of occurrence of detection error for each print setting.

Further, for example, the printing apparatus may include a support unit that supports the print medium to face the discharge head, a setting of a gap between the support unit and the discharge head can be changed, and the information held by the setting history holding unit may include information related to the gap between the support unit and the discharge head. As the gap between the support unit and the discharge head becomes large, the amount of generation of the mist becomes large, so that the gap becomes information that indicates the degree of progress of the stain. Therefore, it is possible to perform more accurate service life management of the signal output unit by storing the gap between the support unit and the discharge head as information related to the print setting.

BRIEF DESCRIPTION OF THE DRAWINGS

The invention will be described with reference to the accompanying drawings, wherein like numbers reference like elements.

FIGS. 7A and 7B are diagrams showing an example of a part of information recorded in a storage.

DESCRIPTION OF EXEMPLARY EMBODIMENTS

Figure 1A:
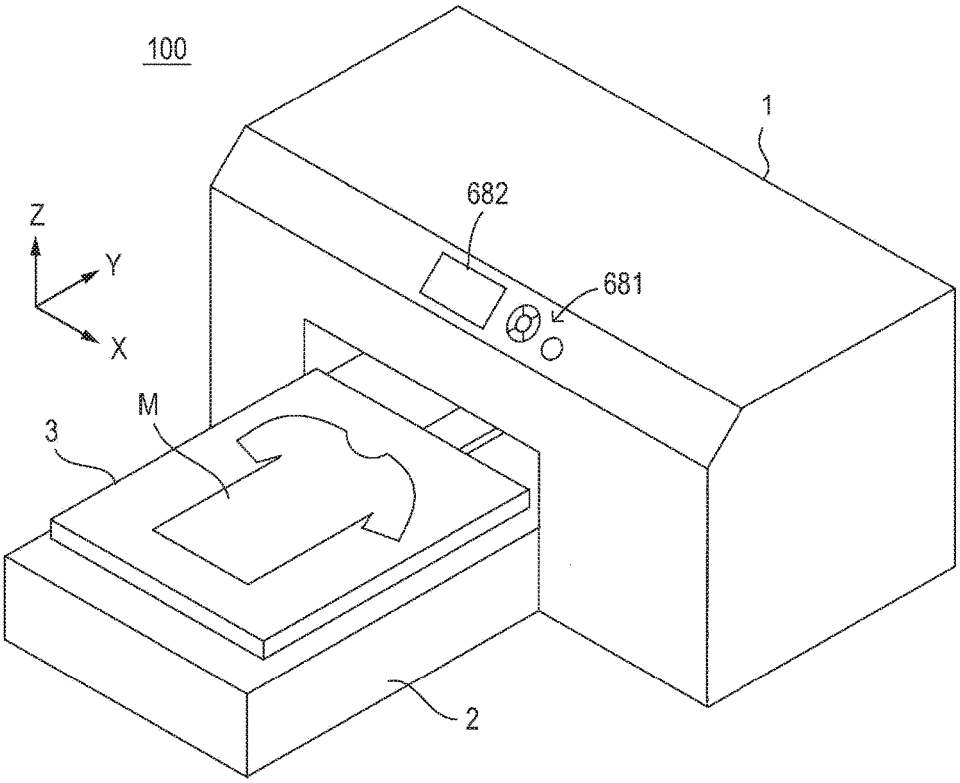
FIGS. 1A and 1B are diagrams showing a printing apparatus that is an embodiment of a printing apparatus of the invention.
Figure 1B:
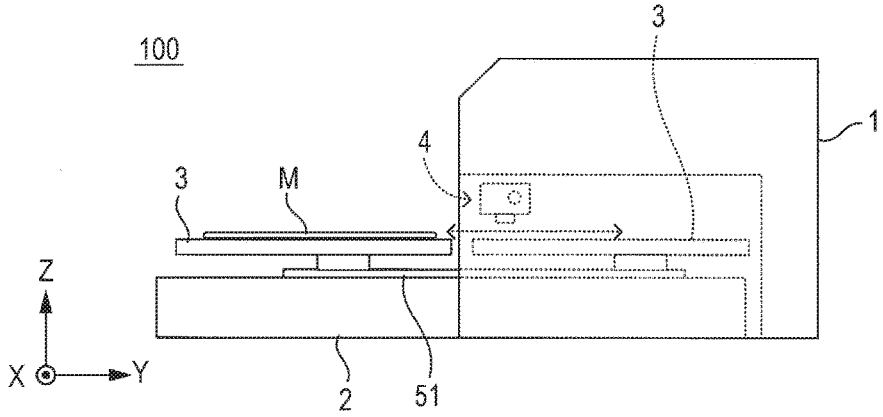
Figure 2:
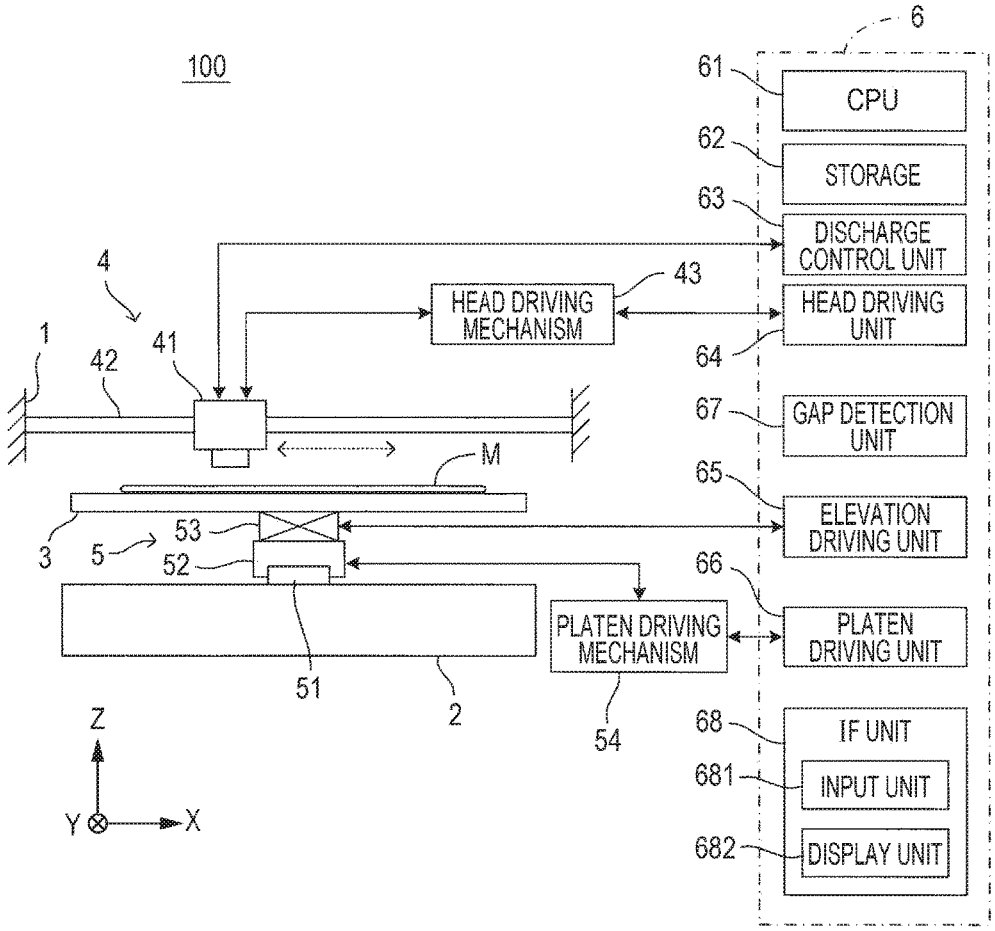
FIG. 2 is a diagram showing a main portion of the printing apparatus.

FIGS. 1A and 1B are diagrams showing a printing apparatus that is an embodiment of a printing apparatus of the invention. More specifically, FIG. 1A is an external perspective view of the printing apparatus 100 and FIG. 1B is a side view showing an internal structure of the printing apparatus 100. FIG. 2 is a diagram showing a main portion of the printing apparatus. The printing apparatus 100 is an apparatus that prints an image on a surface of a print medium M mounted on a platen by an ink jet method. For example, a textile such as a T-shirt is envisaged as the print medium M. However, the print medium M is not limited to textiles. In the drawings described below, to show directions in a uniform manner, an XYZ rectangular coordinate system is set as shown in FIG. 1A. Here, the XY plane represents a horizontal plane and the Z direction represents an upward vertical direction.

The printing apparatus 100 includes an apparatus main body 1 and a support base 2 protruding in a direction in which a print medium is transported from the apparatus main body 1 during printing, that is, a (−Y) direction. A (−Y) side end surface of the apparatus main body 1 corresponds to a front surface of the printing apparatus 100. As shown in FIGS. 1A and 1B, approximately a half of the support base 2 on the (+Y) side is housed in a cavity portion provided in a lower central portion of the apparatus main body 1 and the apparatus main body 1 is provided so as to straddle over the support base 2 and cover an upper surface of the support base 2.

A platen 3, on the upper surface of which a print medium is mounted, is provided movably along the Y direction on the support base 2. As shown by a solid line in FIG. 1B, when the platen 3 moves to the most (−Y) side in a movable range of the platen 3, approximately the entire platen 3 is exposed to outside and an upper portion of the platen 3 is widely opened. In this state, it is easy to mount a print medium on the platen 3 and remove a print medium from the platen 3. On the other hand, as shown by a dotted line in FIG. 1B, when the platen 3 moves to the most (+Y) side in the movable range of the platen 3, approximately the entire platen 3 is housed in the cavity portion of the apparatus main body 1.

A printing mechanism 4 that prints an image by discharging ink droplets to a print medium mounted on the platen 3 is provided in the cavity portion of the apparatus main body 1. Specifically, as shown in FIG. 1B, a discharge head 41 of the printing mechanism 4 is arranged above a portion near a (−Y) side end portion of the upper surface of the platen 3, which is positioned at the most (+Y) side and is housed in the apparatus main body 1, so as to face the upper surface of the platen 3.

An input unit 681 including scan buttons that receive an operation input from a user and a display unit 682 including a display that displays a message to the user are provided on an upper portion of a front surface of the apparatus main body 1. The input unit 681 and the display unit 682 may be integrated together by using, for example, a touch panel.

As shown in FIG. 2, the printing mechanism 4 includes a guide rail 42 and a head driving mechanism 43 in addition to the discharge head 41. The guide rail 42 extends in the X direction, which is a direction crossing a direction in which a print medium is transported, along the upper surface of the platen 3 in the cavity of the apparatus main body 1 and supports the discharge head 41 movably in the X direction. The discharge head 41 has the same structure as that of a discharge head of an ink jet printing apparatus. A plurality of discharge openings are arranged in the X and Y directions in a lower portion of the discharge head 41. The head driving mechanism 43 has an appropriate mechanism such as, for example, a ball screw mechanism, a linear motor, or a belt drive mechanism to cause the discharge head 41 to reciprocate in the X direction along the guide rail 42.

When the discharge head discharges ink droplets downward while performing scanning movement in the X direction along the guide rail 42, the ink droplets adhere to the print medium mounted on the platen 3 and a belt-shaped image extending in the X direction is formed on a surface of the print medium. It is possible to form a two-dimensional image on the surface of the print medium by combining the above operation and a movement of the platen 3 in the Y direction.

A support mechanism 5 that supports the platen 3 from below is provided between the support base 2 and platen 3. More specifically, in the support mechanism 5, a guide rail 51 extending in the Y direction is attached to the upper surface of the support base 2 and a slider 52 is slidably attached to the guide rail 51. The slider 52 can be reciprocated in the Y direction along the guide rail 51 by a platen driving mechanism 54 including an appropriate mechanism such as, for example, a ball screw mechanism, a linear motor, or a belt drive mechanism.

The slider 52 supports the platen 3 through an elevating mechanism 53. Specifically, the slider 52 is attached with the elevating mechanism 53 including an appropriate mechanism such as, for example, a ball screw mechanism, a piezoelectric actuator, a solenoid, or a worm gear mechanism, and the elevating mechanism 53 is attached with the platen 3. When the elevating mechanism 53 is actuated, the platen 3 moves up or down in the Z direction which is a direction in which the discharge head 41 discharges ink. Thereby, it is possible to adjust a gap (a platen gap) GP between the upper surface of the platen 3 and the lower surface of the discharge head 41 within a predetermined range. Thereby, the printing apparatus 100 can well print an image on print media with various thicknesses. A mechanism for adjusting the platen gap GP may be not only a mechanism that automatically sets the gap by using active mechanical elements as described above, but also may be a mechanism where a user manually adjusts the gap.

The printing apparatus 100 further includes a control unit 6 for controlling operations of each component of the apparatus described above. The control unit 6 includes a CPU (Central Processing Unit) 61 that controls operations of the entire apparatus and a storage 62 that stores a control program executed by the CPU 61 and various data. When the CPU 61 executes a predetermined control program, the following functional blocks are realized in the control unit 6.

The functional blocks realized by the CPU 61 includes a discharge control unit 63, a head driving unit 64, an elevation driving unit 65, a platen driving unit 66, and a gap detection unit 67. The discharge control unit 63 performs printing by controlling the discharge head 41 based on image data that represents an image to be printed and causing ink to be discharged from each discharge opening of the discharge head 41 at a predetermined timing. The head driving unit 64 controls the head driving mechanism 43 and realizes the scanning movement of the discharge head 41 with respect to the print medium in the X direction. As described later, a linear encoder for detecting the displacement of the discharge head 41 is provided to appropriately perform position control of the discharge head 41 in the X direction.

The elevation driving unit 65 controls the elevating mechanism 53 and performs positioning of the platen 3 in the Z direction. The gap detection unit 67 detects the size of the platen gap GP in the Z direction in cooperation with a detection unit not shown in the drawings. As the detection unit, it is possible to use a detection unit that detects a distance by using an appropriate known technique that can detect a distance, for example, a direction unit that detects a distance by using an optical means or a mechanical means and a detection unit that detects a distance by using an ultrasonic wave. The elevation driving unit 65 controls the elevating mechanism 53 according to the size of the platen gap GP detected by the gap detection unit 67, so that the platen gap GP is adjusted to a predetermined size.

The control unit 6 is provided with an interface (IF) unit 68 that assumes communication with a user and an external apparatus. The input unit 681 and the display unit 682 provided to the apparatus main body 1 are a part of the interface unit 68. The interface unit 68 performs data exchange with an external apparatus communicably connected to the printing apparatus 100 through a communication line such as a LAN (Local Area Network) line and the Internet line.

Figure 3A:
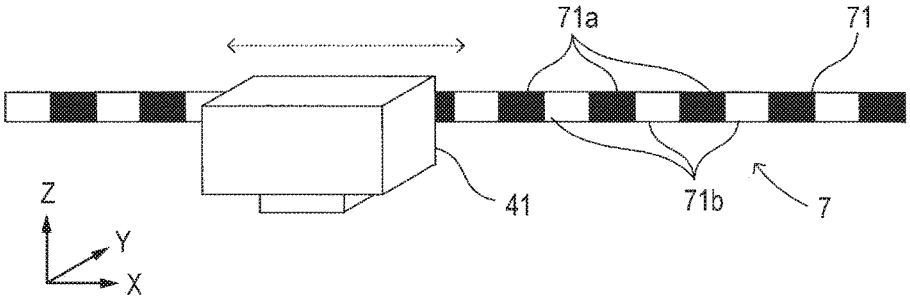
FIGS. 3A to 3C are diagrams showing a configuration of a linear encoder.
Figure 3B:
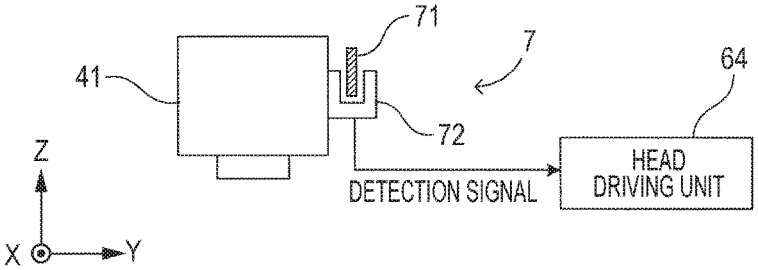
Figure 3C:
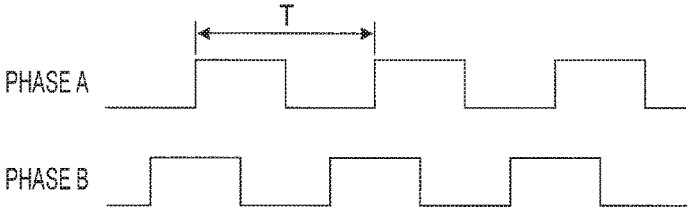

FIGS. 3A to 3C are diagrams showing a configuration of the linear encoder. More specifically, FIG. 3A is a diagram showing a positional relationship between the linear encoder 7 and the discharge head 41, and FIG. 3B is a side view of FIG. 3A. FIG. 3C is a diagram showing an example of a signal outputted from the linear encoder 7. As shown in FIG. 3A, the linear encoder (hereinafter simply referred to as an "encoder") 7 has a reference scale 71 in which high density parts 71*a* and low density parts 71*b* are alternately arranged at a constant pitch in the X direction. Therefore, in the reference scale 71, optical density changes stepwise and periodically along the X direction. The reference scale 71 is fixed to the apparatus main body 1. Lengths of the high density parts 71*a* and the low density parts 71*b* in the reference scale 71 need not be the same. In other words, the lengths may vary by location, and the high density parts 71*a* and the low density parts 71*b* may be discontinuous. When the lengths of the high density parts 71*a* and the low density parts 71*b* are long, even if some dirt sticks, it does not affect reading of signal so much. Therefore, it is possible to postpone the expiration of the life of the encoder.

As shown in FIG. 3B, the encoder 7 includes a photo-sensor 72 attached to a side surface of the discharge head 41. The photo-sensor 72 has a photo-detection element (not shown in the drawings) provided so as to face a surface of the reference scale 71 and optically reads the surface of the reference scale 71. The photo-sensor 72 relatively moves with respect to the reference scale 71 fixed to the apparatus main body 1 according to the scanning movement of the discharge head 41. Here, the reference scale 71 may be installed, for example, in parallel with the guide rail 51.

The photo-sensor 72 outputs a detection signal whose strength varies according to optical density of the surface of the reference scale 71 facing the photo-sensor 72. Therefore, the strength level of the detection signal varies as shown in FIG. 3C, so that the detection signal is a periodic signal that varies according to the density change of the surface of the reference scale. The level variation of the signal indicates a displacement of the discharge head 41 and the variation timing changes corresponding to the moving speed of the discharge head 41. Therefore, it is possible to obtain the scanning movement speed of the discharge head 41 from a variable period T of the detection signal.

In the photo-sensor 72, two photo-detection elements are provided at different positions in the scanning movement direction of the discharge head 41, that is, the X direction, and two detection signals with phases different from each other are outputted from two light receiving elements. The two detection signals of phase A and phase B in FIG. 3C correspond to the above detection signals. The photo-sensor 72 outputs two detection signals with phases different from each other, so that it is possible to detect not only the moving speed of the discharge head 41, but also the moving direction of the discharge head 41.

The head driving unit 64 controls the head driving mechanism 43 to reciprocate the discharge head 41 in the X direction based on the detection signals outputted from the encoder 7 configured as described above. Thereby, the scanning movement of the discharge head 41 with respect to the print medium on the platen 3 is realized.

Figure 4A:
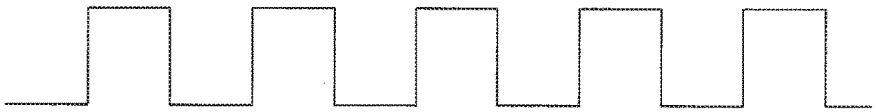
FIGS. 4A to 4E are diagrams showing a waveform example of a detection signal.
Figure 4B:
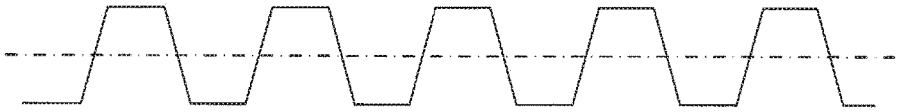

FIGS. 4A to 4E are diagrams showing a waveform example of a detection signal. When the discharge head 41 properly performs scanning movement, it is ideal that the detection signal outputted from the encoder 7 is a rectangular wave signal where a binary is periodically repeated as shown in FIG. 4A. However, actually, unless the resolution of the photo-sensor 72 is sufficiently high, as shown in FIG. 4B, the detection signal is a trapezoidal wave where the rise and fall of the signal is more gradual. In this case, as shown by the dashed-dotted line in FIG. 4B, it possible to shape the waveform by binarizing the signal using an appropriate threshold value, and thereby it is possible to detect the displacement of the discharge head 41.

However, the encoder 7 is provided close to the discharge head 41 that discharges ink, so that the reference scale 71 or the photo-sensor 72 is stained by adhesion of ink mist flying from the discharge head 41 and thereby the strength level of the detection signal may vary. For example, when printing to a print medium whose ground color is not white, the printing may be performed using white ink as a base coat to improve coloring. However, a large amount of white ink is used, so that the amount of flying ink also increases.

Figure 4C:
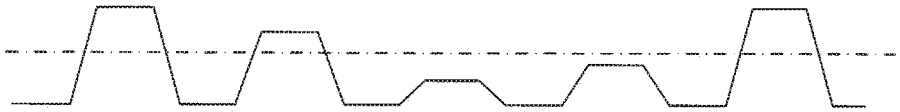
Figure 4D:
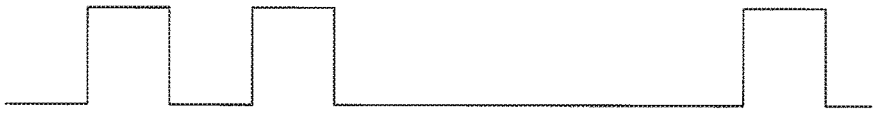

When the photo-sensor 72 is stained, a level difference between the two values in the waveform in FIG. 4B becomes small uniformly, so that the dynamic range of the detection signal is degraded. When the reference scale 71 is stained, the degree of stain varies depending on a position, so that the strength level of the signal varies as shown in FIG. 4C. Therefore, when binarizing the signal based on a single threshold value shown by the dashed-dotted line, there may be missing waveforms as shown in FIG. 4D. When there are such missing waveforms, it is not possible to appropriately detect displacement of the discharge head 41 based on the variation timing of the waveform, so that it causes problems in the moving control of the discharge head 41. As a result, it is not possible to properly perform the print processing and it means that the service life of the encoder 7 has expired.

If observing the variation of the strength level of the detection signal before such a situation occurs, it is possible to take some countermeasures before a false detection of the displacement of the discharge head 41 occurs. For example, it is possible to estimate a time when data will not be able to be read correctly from the encoder 7, that is, a time when the service life of an encoder 7 will run out, and to clean the apparatus or prepare a replacement part in advance. Further, it is possible to delay the time when the service life of the encoder 7 expires by changing an operation mode of the apparatus.

Figure 4E:
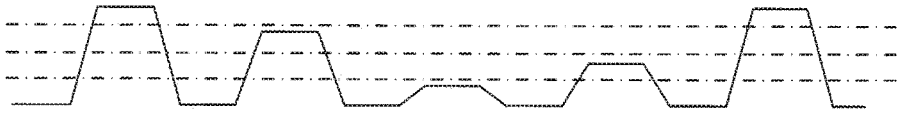

For example, as shown by a plurality of dashed-dotted lines in FIG. 4E, when detecting the strength level of the detection signal by causing the strength level of the detection signal to be multi-valued by a plurality of threshold values, it is possible to detect the stain of the encoder 7 earlier than when a false detection occurs. That is to say, it is possible to observe a changing trend of the strength level of the detection signal before the missing of the binary waveform (FIG. 4D) that causes a false detection occurs.

Figure 5:
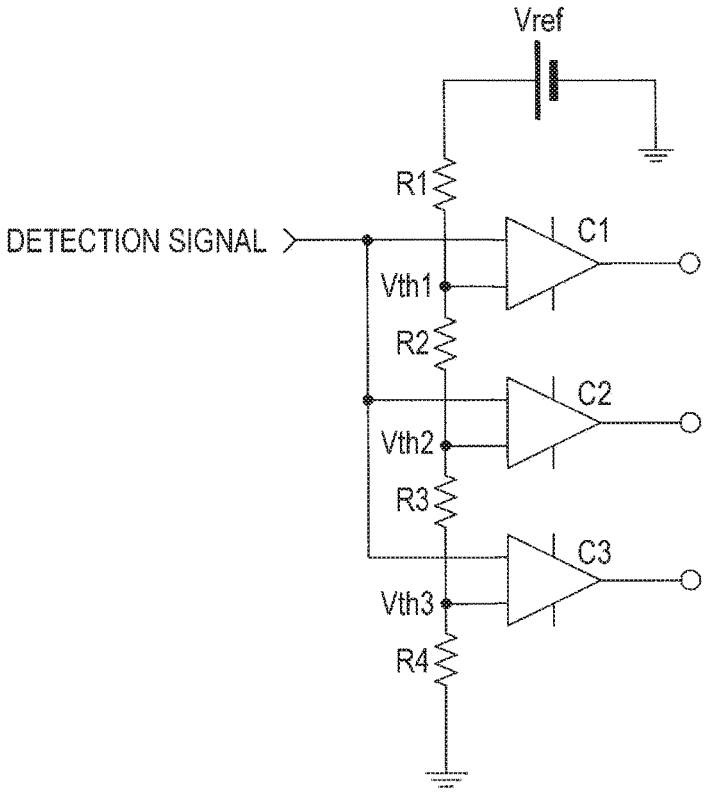
FIG. 5 is a diagram showing an example of a circuit that causes the detection signal to be multi-valued.

FIG. 5 is a diagram showing an example of a circuit that causes the detection signal to be multi-valued. In a multi-valuing circuit 641, a reference voltage Vref is divided by serially connected resistors R1 to R4 and three threshold voltages Vth1 and Vth3 are generated. These threshold voltages Vth1 and Vth3 are inputted into comparison input terminals of three comparators C1 to C3, respectively. On the other hand, the detection signal outputted from the photo-sensor 72 of the encoder 7 is inputted into a signal input terminal of the comparator C1 to C3.

In a configuration as described above, a combination of output signals (H level or L level) from the three comparators C1 to C3 varies in four ways according to a magnitude relation between the strength level of the detection signal and the three threshold voltages Vth1 and Vth3. Thereby, levels from the maximum level to the minimum level of the detection signal strength can be converted into a four-valued signal. When each threshold voltage is properly set, it is possible to appropriately estimate the stain of the encoder 7 even before a false detection occurs. The multi-valuing circuit 641 is installed in the head driving unit 64 of the control unit 6.

It is possible to cause the detection signal to be multi-valued by using a method other than the above, for example, a method that analog-digital converts the detection signal to make a multi-valued digital signal, and the method can be used to detect the stain of the encoder 7 in the same manner as described above.

According to knowledge of the inventor of the present application, the amount of generation of the mist from the discharge head 41 varies depending on a print mode that is set when printing is performed. In each print mode such as a high speed print mode and a high definition print mode, various print parameters that affect print quality are finely set and the amount of generation of the mist varies depending on a combination of the parameters. In the printing apparatus 100 as described in the present embodiment, main parameters that affect the amount of generation of the mist are the size of the ink droplet determined by setting of the resolution and the size of the platen gap GP.

In particular, regarding the platen gap GP, a user tends to desire a gap setting larger than an appropriate value in order to avoid that the discharge head 41 comes into contact with a print medium during printing and the printing fails. The greater the distance between the discharge head 41 and the print medium, the greater the amount of generation of the mist. Therefore, too large platen gap GP setting shortens the service life of the encoder 7. However, the user does not know the above phenomenon or the user prioritizes the avoidance of the contact described above even if the user know the above phenomenon, so that the user may set the gap setting greater than an appropriate value.

When the apparatus is used in a state in which the apparatus is not set in an appropriate setting, that is, in an unexpected state, it is difficult to estimate in advance how the deterioration of each component such as the encoder 7 will progress. Therefore, in the printing operation of the present embodiment, the setting state of the print mode that is set by a user and how the strength level of the detection signal from the encoder 7 is changed by the printing performed under the setting are accumulated and stored as history information, and a degree of progress of stain for each print mode is estimated based on the accumulated and stored data.

Hereinafter, the printing operation of the present embodiment in consideration of the stain of the encoder 7 due to the ink mist will be described. The printing operation of the printing apparatus 100 is realized when the CPU 61 executes a predetermined program and causes each component of the apparatus to perform a predetermined operation according to an instruction input from a user.

Figure 6:
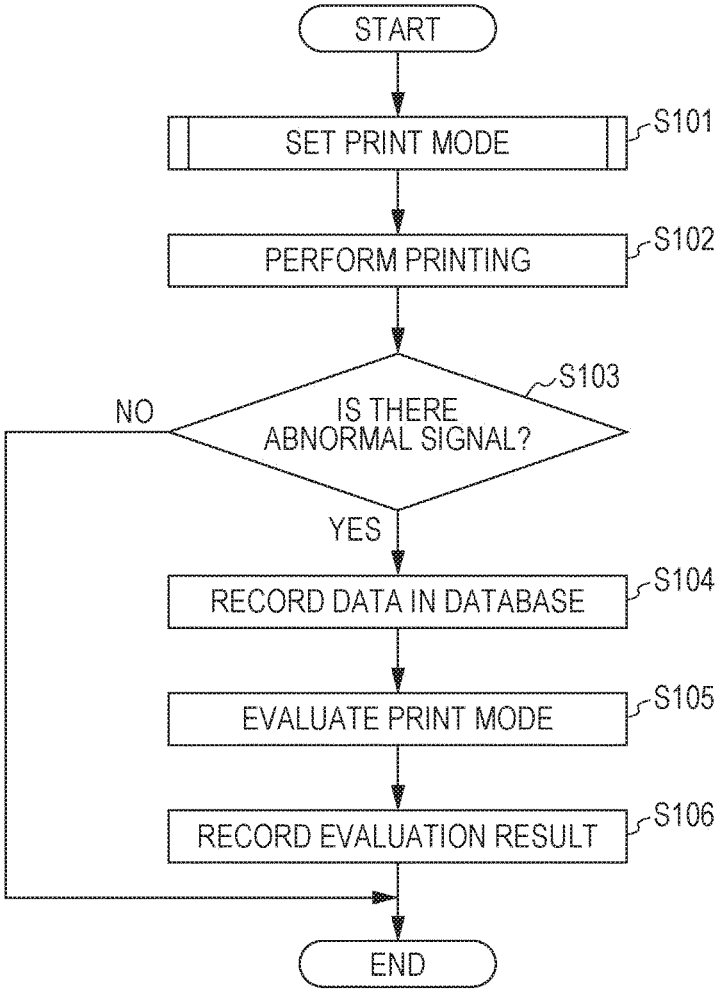
FIG. 6 is a flowchart showing a printing operation of the embodiment.

FIG. 6 is a flowchart showing the printing operation of the embodiment. When a print medium is set on the platen 3 and image data of an image to be printed and an instruction input to perform printing are given from a user, a setting of the print mode is performed (step S101). The processing content of the above will be described later. When the print mode is set, printing is performed in the set print mode (step S102). During this time, in the head driving unit 64, the moving control of the discharge head 41 is performed based on the variation timing of the detection signal from the encoder 7 and the multi-valuing circuit 641 causes the detection signal to be multi-valued at a predetermined period.

While the printing is performed, if an abnormality of the multi-valued detection signal is detected (YES in step S103), the following steps S104 to S106 are performed. On the other hand, if there is no abnormality (NO in step S103), these processing steps are skipped and the printing operation ends. Regarding the abnormality of the detection signal, for example, it is possible to determine that the detection signal is abnormal when the level of the multi-valued detection signal is an intermediate value other than the maximum level and the minimum level. Further, when a false detection occurs in displacement detection of the discharge head based on the detection signal and an error occurs, it is possible to determine that the detection signal is abnormal. This is because when the frequency of the false detection is low and the signal can be interpolated from signals before and after the signal, it can be assumed that the degree of abnormality is low.

When there is abnormality of the detection signal, details of the abnormality and information for identifying the print mode that is set at that time are recorded in an abnormality history database provided in the storage 62 in advance (step S104).

FIGS. 7A and 7B are diagrams showing an example of a part of information recorded in the storage. FIG. 7A shows the aforementioned abnormality history database. In the abnormality history database, each abnormality that has occurred is distinguished by a serial number, and the print mode that is set when the abnormality occurs, the execution time of the printing operation, and detailed information such as, for example, the value of the detected multi-valued signal and the number of times of occurrence of abnormality during the printing operation are recorded. The execution time of the printing operation is an example of information that indicates an operation amount of the discharge head 41. Instead of or in addition to the execution time of the printing operation, it is possible to use, for example, the number of scanning movements of the discharge head 41 in the printing operation and a dot count value corresponding to the amount of discharged ink.

Other than the above information, various information such as, for example, a temperature and humidity measurement result may be recorded. When the printing ends without abnormality of the detection signal, information indicating that may be recorded in the abnormality history database. Every time a new abnormality is detected when performing printing, data is added.

Subsequently, evaluation of the print mode is performed based on the data recorded in the abnormality history database (step S105). More specifically, a degree of progress of stain of the encoder 7 is evaluated for each print mode.

As described above, when an abnormality of the detection signal of the encoder 7 occurs in a printing operation, information indicating that is recorded and accumulated in the abnormality history database. It is possible to evaluate a correlation between the print mode and an abnormality occurrence status of the detection signal, that is, a correlation between the print mode and the degree of progress of stain of the encoder 7, from the accumulated data. For example, it can be said that a print mode where an abnormality occurrence frequency per printing or per unit operation amount of the discharge head 41 is significantly higher (or lower) than that in other print modes is a print mode where the degree of progress of stain due to generation of mist is high (low). When a print mode where the amount of generation of the mist is large is used, it is assumed that the stain of the encoder 7 progresses fast. The result of the evaluation is recorded in an evaluation table prepared in the storage 62 (step S106). When these processing operations are completed, the printing operation ends.

FIG. 7B is a diagram showing an example of the evaluation table of the print mode. In this example, evaluation results of three types of print modes named A to C are shown. In the evaluation table, for each print mode, setting values of print parameters in the print mode and the degree of progress of stain in the print mode (for example, the degree of progress of stain can be shown by the amount of generation of the mist) are recorded. Here, as the print parameters, only the platen gap PG and the resolution during printing are representatively written. However, various print parameters other than those are also recorded. Among the setting values of the print parameters included in the print modes, setting values that clearly do not affect generation of the mist should not necessarily be recorded.

In the example shown in FIG. 7B, a level of the amount of generation of the mist is represented in three stages as an evaluation for each print mode. However, more specifically, for example, it is possible to quantitatively obtain the degree of progress of stain per unit operation amount based on the data accumulated in the abnormality history database and record the degree of progress of stain along with the evaluation result. By doing so, it is possible to somewhat quantitatively estimate how much the stain progresses when the print mode is used next time, so that it is possible to estimate a timing at which the service life of the encoder 7 expires.

In this way, a correlation between the print mode and the degree of progress of stain of the encoder 7 while printing is performed in the print mode is evaluated. As a result, a print mode in which the stain progresses fast and a print mode in which the stain progresses slowly are known. In particular, it is possible to determine that a print mode in which many errors occur in the displacement detection of the discharge head 41 is a print mode in which the stain progresses fast. When a new evaluation is performed, the evaluation table is updated as needed. As described below, the evaluation table in which evaluation results are recorded is used when a new print mode is set in the next printing operation.

Figure 8:
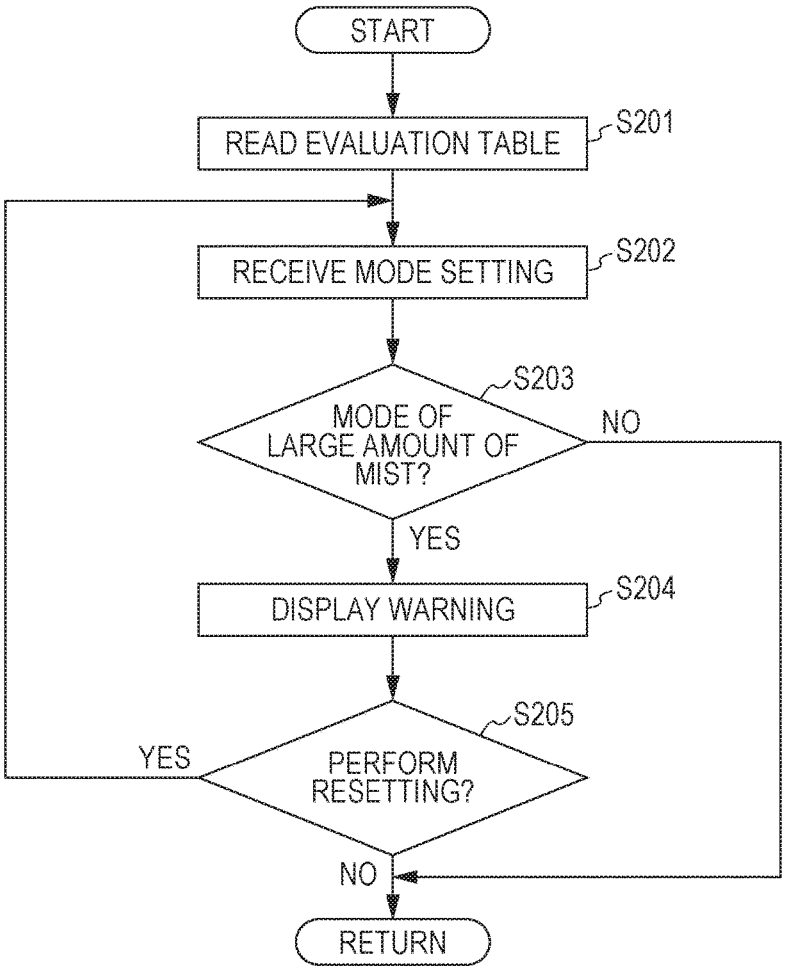
FIG. 8 is a flowchart showing print mode setting processing.

FIG. 8 is a flowchart showing print mode setting processing. More specifically, FIG. 8 shows print mode setting processing performed as step S101 of the printing operation shown in FIG. 6. When a new printing operation is performed according to an instruction input from a user, the print mode setting processing shown in FIG. 8 is performed. First, the evaluation table is read from the storage 62 to refer to the evaluation result of each print mode based on the data accumulated by the printing operations that have been performed (step S201). Subsequently, a print mode setting instruction given from the user is received through an external terminal apparatus or the input unit 681 (step S202).

Then, based on the evaluation table, it is determined whether or not the given print mode is a print mode in which a large amount of mist is generated (step S203). When a print mode where the amount of generation of the mist is large is performed, of course, the stain of the linear encoder 7 progresses fast, so that the service life of the linear encoder 7 is shortened. On the other hand, if selection of a print mode in which the amount of generation of the mist is smaller is allowed as a substitute mode, it is possible to further delay the time when the service life of the encoder 7 expires.

Therefore, when a selected print mode is a mode in which the amount of generation of the mist is large (YES in step S203), a warning message for notifying the user that the print mode may shorten the service life of the encoder 7 is displayed on the display unit 682 (step S204). Along with the warning message, a message that asks the user whether the current print mode is performed without change or the setting of the print mode will be performed again is displayed.

When information necessary to estimate the service life of the encoder 7 is recorded in the evaluation table, the CPU 61 estimates the service life in a case in which the currently selected print mode is performed and the result of the estimation may be displayed on the display unit 682. Further, a message may be displayed which guides a print mode in which an image quality that is the same as or close to that of the selected print mode can be obtained and the amount of generation of the mist is smaller than that of the selected print mode.

When the user desires to perform the setting again (YES in step S205), the process returns to step S202 and a setting of a new print mode is received. On the other hand, when the user does not desire to perform the setting again (NO in step S205), the current print mode setting is determined and the print processing shown in FIG. 6 is performed. When a print mode is selected in which the amount of generation of the mist is small and which does not shorten the service life of the encoder 7 (NO in step S203), the steps S204 and S205 are skipped and the selected print mode is determined.

As described above, in the printing apparatus 100 of the present embodiment, the state and the speed of the scanning movement of the discharge head 41 are detected from the variation timing of the detection signal obtained by optically reading the reference scale 71, and the moving control of the discharge head 41 is performed based on the detected state and speed of the scanning movement. At this time, the variation of the strength level of the detection signal caused by the stain of the encoder 7 is detected, and the degree of progress of the stain is detected from the detection result.

Thereby, before the stain of the encoder 7 progresses and the moving control of the discharge head 41 cannot be performed, it is possible to appropriately perform the service life management of the encoder 7 while the stain progresses. As a result, it is possible to avoid printing in a setting that significantly reduces the service life and estimate a timing at which the service life of the encoder 7 expires to prepare a countermeasure against it in advance.

As described above, in the printing apparatus 100 of the embodiment described above, the discharge head 41 functions as a "discharge head" of the invention and the print medium M corresponds to a "print medium" of the invention. The platen 3 functions as a "support unit" of the invention. The reference scale 71 and the photo-sensor 72 respectively function as a "reference scale" and a "reading unit" of the invention. The linear encoder 7 including the reference scale 71 and the photo-sensor 72 functions as a "signal output unit" of the invention.

In the embodiment described above, the head driving unit 64 has both a function as a "displacement detection unit" of the invention and a function as a "stain detection unit" of the invention. The storage 62 that holds the abnormality history database and the evaluation table has both a function as a "signal history holding unit" of the invention and a function as a "setting history holding unit" of the invention. In the embodiment described above, the CPU 61 has both a function as an "evaluation unit" of the invention and a function as an "estimation unit" of the invention, and the display unit 682 functions as a "notification unit" of the invention.

The invention is not limited to the embodiment described above and it is possible to variously modify the embodiment described above without departing from the scope of the invention. For example, in the embodiment described above, the stain of the encoder 7 is detected based on the multi-valued result of the strength level of the detection signal from the encoder 7. Instead of this, for example, the stain of the encoder 7 may be detected based on the magnitude of the level difference between the H level and the L level of the detection signal. This is because it is considered that when the ink is attached to the encoder 7, a level difference between a signal corresponding to the high density part 71*a* and a signal corresponding to the low density part 71*b* in the reference scale 71 becomes small.

In the embodiment described above, the detection result of the stain of the encoder 7 based on the detection signal from the encoder 7 is used as reference information when evaluating the print mode and setting a new print mode. However, the usage of the stain detection result is not limited to this and can be arbitrarily used. For example, the stain detection result can be used as reference information to notify a user of timing of cleaning the encoder 7 at an appropriate timing.

The embodiment described above is a printing apparatus that performs printing by transporting the print medium M to a position facing the discharge head 41 by moving the platen 3 on which the print medium M is mounted. However, the transport method of the print medium is not limited to this. For example, the invention can be effectively applied to a printing apparatus that transports a print medium by using rollers and a printing apparatus that transports a print medium by winding the print medium around a drum.

This application claims priority under 35 U.S.C. §119 to Japanese Patent Application No. 2015-129590, filed Jun. 29, 2015. The entire disclosure of Japanese Patent Application No. 2015-129590 is hereby incorporated herein by reference.

What is claimed is:

1. A printing apparatus comprising:

a discharge head that performs scanning movement with respect to a print medium and discharges ink to a surface of the print medium;

a signal output unit including a reference scale in which optical density changes stepwise along a scanning movement direction of the discharge head and a reading unit that optically reads the reference scale and outputs a signal according to the optical density, the reference scale and the reading unit moving relatively with each other along with the movement of the discharge head;

a stain detection unit that detects stain of the signal output unit based on a detection result of a strength level of the signal; and a signal history holding unit that holds information related to a history of change in the strength level of the signal.

2. The printing apparatus according to claim 1, wherein the stain detection unit detects the strength level of the signal by converting the signal into a multi-valued data of three values or more.

3. The printing apparatus according to claim 1, further comprising:

a setting history holding unit that holds information related to a history of a print setting; and an evaluation unit that evaluates a correlation between the print setting and the stain based on the information held by the signal history holding unit and the information held by the setting history holding unit.

4. The printing apparatus according to claim 3, further comprising:

a notification unit that notifies a user of a print setting that is evaluated to be highly correlated with the stain by the evaluation unit.

5. The printing apparatus according to claim 4, wherein the notification unit notifies a user of a print setting whose correlation with the stain is lower than that of the current print setting.

6. The printing apparatus according to claim 3, further comprising:

an estimation unit that estimates a service life of the signal output unit in printing based on one print setting, based on an evaluation result of the evaluation unit.

7. The printing apparatus according to claim 3, wherein the setting history holding unit integrates an operation amount of the discharge head under a print setting for each print setting.

8. The printing apparatus according to claim 3, further comprising:

a displacement detection unit that detects a displacement of the discharge head based on a detection result of a variation timing of the signal during a period in which the discharge head performs scanning movement, wherein the setting history holding unit holds the number of times of occurrence of detection error of the displacement in the displacement detection unit for each print setting.

9. The printing apparatus according to claim 3, further comprising:

a support unit that supports the print medium to face the discharge head, wherein a setting of a gap between the support unit and the discharge head can be changed, and the information held by the setting history holding unit includes information related to the gap between the support unit and the discharge head.

* * * * *